US007519195B2

(12) United States Patent
Hesketh

(10) Patent No.: US 7,519,195 B2
(45) Date of Patent: Apr. 14, 2009

(54) SOUND SYSTEM FOR INDUSTRIAL TOOL CHESTS

(76) Inventor: Howard W. Hesketh, 2694 Victron Dr., St. Louis, MO (US) 63129

( * ) Notice: Subject to any disclaimer, the term of this patent is extended or adjusted under 35 U.S.C. 154(b) by 888 days.

(21) Appl. No.: 10/946,699

(22) Filed: Sep. 22, 2004

(65) Prior Publication Data

US 2006/0062415 A1 Mar. 23, 2006

(51) Int. Cl.
*H04R 1/02* (2006.01)
*H04R 9/06* (2006.01)

(52) U.S. Cl. ..... 381/334; 381/333; 381/345; 381/361; 381/388; 181/145; 181/189; 181/198; 181/199; 455/347

(58) Field of Classification Search ..... 381/150, 381/87, 333, 335, 345, 361, 388; 312/7.1, 312/8.1, 9.1; 181/175, 145, 189, 198, 199; 455/347

See application file for complete search history.

(56) References Cited

U.S. PATENT DOCUMENTS 3,926,487 A * 12/1975 Reyes ..... 312/234
4,843,624 A * 6/1989 Rashak ..... 381/91
4,896,070 A * 1/1990 Reid et al. ..... 312/290
5,781,853 A * 7/1998 Johnson ..... 455/351
5,810,168 A * 9/1998 Eggering ..... 206/372
6,968,067 B2 * 11/2005 Lopez ..... 381/334
2003/0223609 A1 * 12/2003 Anderson et al. ..... 381/333

* cited by examiner

*Primary Examiner*—Xu Mei
*Assistant Examiner*—Fatimat O Olaniran
(74) *Attorney, Agent, or Firm*—Charles McCloskey

(57) ABSTRACT

A sound system for industrial tool chests modifies a tool chest with drawers to provide sound and music to technicians at work in a shop. The sound system has a power supply and electronics mounted in the vacant spaces within a tool chest. The power supply has ducting and a fan for cooling. Wiring delivers power from the power supply to the electronics and a player. The electronics include a dropping resistor and illuminated on-off switch. The player can play one or all of AM, FM, and other radio bands, broadcast or cable TV, video and other digital signals, and recorded media of many kinds. The player distributes a signal to two or more speakers mounted to the bottom of the tool chest, and alternatively in the top. The present invention installs within single chests and multiple story chests. Sound from the speakers reflects upon a shop floor to send music throughout the shop.

8 Claims, 4 Drawing Sheets

SOUND SYSTEM FOR INDUSTRIAL TOOL CHESTS

BACKGROUND OF THE INVENTION

The sound system for industrial tool chests relates generally to stereo systems and more specifically to speaker boxes.

Technicians in shops and garages often like music while working. Music passes the time during difficult or boring tasks. Technicians have used portable stereos to provide that music. Portable stereos occupy valuable space on the workbench and get banged up and dirty. Portable stereos generally have poorer sound quality than a home stereo or car stereo system. In a shop, the lack of acoustics and shop background noise encourages technicians to play the portable stereos loud. The resulting sound may irritate management and customers in the shop.

In shops, technicians often utilize tool storage chests. The tool storage chests have various sizes and usually contain stacked drawers within a frame. The frame usually has wheels for movement of a loaded chest that may weigh in excess of five hundred pounds. Inside of the frame, outside of the stacked drawers, and beneath a chest, the frame has vacant space not normally used for tool storage but available for other purposes.

Generally, a stereo system includes speakers that have a magnet proximate to a rim. The rim attaches to an enclosure and denotes front in reference to a speaker. Opposite the rim, the magnet at the base of the diaphragm denotes rear inference to a speaker. Application of electricity to the voice coil from the amplifier or tuner of the stereo system cause motion of the diaphragm and induces sound waves. Typically the sound waves emanate from the diaphragm towards the front. Front sound waves or condensation can travel around the rim towards the rear. The front sound waves may cancel a portion of the rear sound waves, nearly eliminating woofer or bass sound frequencies.

To prevent cancellation of the rear sound wave, speakers generally have an enclosure. The enclosure permits propagation of front sound waves but the walls of the enclosure defeat a front sound wave that attempts to reach the rear. Defeating front sound waves is commonly called baffling. Some enclosures have a vent or port that releases sounds of resonant frequencies from within the cabinet.

The vacant interior space in the frame and beneath the chest provides rear sound wave baffling for speakers. Akin to a speaker box in a typical stereo, a tool chest encloses speakers and prevents cancellation. Bass and other resonant frequencies emanate from gaps between drawers and other gaps in the tool chest. The shop floor beneath the speakers provides a surface that directs sound into the shop as front sound waves bounce off the shop floor.

DESCRIPTION OF THE PRIOR ART

With the human affinity for music and music's ability to ease difficult and boring tasks, tradesmen, or technicians, of all kinds have adapted and developed portable stereo systems. Hand carried toolboxes have received electronic components and rugged housings. Development and modification of portable stereos are known in the prior art.

The patent to Yuen, No. D310,529, shows a portable boom box as a toolbox. Like the present invention, the patented toolbox has a speaker and components within a box. However unlike the present invention, this patent has front mounted speakers and use as a boom box.

The patent to Ellefson, U.S. Pat. No. 4,976,540, shows a mobile technician's tool chest of drawers. Akin to the present invention, this patent has an electrical box mounted beneath the drawers as shown in FIG. 1. In contrast to the present invention, this patent has a counterweight for stability, rotating drawers and doors, slotted holes for tools, and no mention of a sound system.

The patent to Labrum, U.S. Pat. No. 5,013,055, shows a hand truck with a generator and a box mounted upon the hand truck. Similar to the present invention, this patent has tools and equipment mounted upon a mobile frame. Different from present invention, this patent has two large wheels likely upon an axle, a generator upon a plate, and a box within a frame.

The patent to Leonovich, Jr., U.S. Pat. No. 5,235,822, shows a stereo in a portable cooler for beverages. Akin to the present invention, this patent has stereo components and batteries in the walls of the cooler. This patent has a similar concept of locating stereo components in the unused space of a cooler. Unlike the present invention, this patent has an antenna located in the cooler handle and battery power.

Then the patent to Eggering, U.S. Pat. No. 5,810,168, shows a hand carried tool box with a radio. Like the present invention, the patent has audio components inside the box as a flat gang and accepts external electric power. Unlike the present invention, the patent applies to hand carried tool boxes and has extra outlets for tools.

The patent to Keseling et al., No. D375,311, illustrates another tool box with a radio. As the present invention does, this patent has audio components within a box and under a lid. However, this patent is a tool box for hand carrying and has the components, outlets, and speakers on the side of the box.

The patent to Domes, U.S. Pat. No. 6,456,837, shows a rugged radio for jobsites. Similar to the present invention, this patent has a radio inside a box, similar components, and an antenna. In contrast to the present invention, this patent has a big emphasis on power supplies, use as a battery charger, front mounted speakers, but it does not store tools.

The patent to Tripoli, U.S. Pat. No. 6,596,941, illustrates a pickup truck box with a grounded electrical outlet. Like the present invention, this patent brings electrical power to a tool box. In contrast to the present invention, this patent lacks stereo components but has an inverter. The wiring harness may have specific dimensions for a pickup or box type.

And then, the patent to Chang, U.S. Pat. No. 6,662,945, describes a clamshell toolbox with a stereo. As in the present invention, this patent has a stereo in the lid or wall of a tool box. However, the patent refers to a hand carried tool box, and a one-piece stereo with its own batteries.

The present invention improves the sound transmission of tool chests and adapts tool chests for stereo components.

SUMMARY OF THE INVENTION

Generally, the present invention provides the speakers and electronic components to modify a tool chest for use as a stereo system. The present invention is an industrial tool chest modified with a stereo system. A tool chest has banks of drawers with leftover space around the drawers that a stereo system can occupy. Above the drawers but beneath the top, the present invention has a power supply, wiring, cooling fan, AM/FM/CD/tape player, removable faceplate, and reinforcing tube. Beneath the lowest drawer, the present invention has two speakers aimed toward the floor and damper pads on the speaker mounting surface, or panel between the wheels. The electronics of the present invention occupy the space above the topmost drawer and below the top surface of the tool chest. A power cord delivers 110 volt electricity to a 12 volt power supply for the cooling fan, player, amplifier and the speakers. An antenna routes radio signals from the outside rear of the chest directly to the player. The electronics occupy the rightmost third of the top. The outer thirds of the bottom each have one speaker mounted to the bottom surface of the tool chest and wired to the electronics in the top. Near the speakers, vibration damper pads that have a generally flat rectangular shape mount to the interior bottom surface as well. The damper pads reduce vibrations induced into the bottom plate of the tool chest by the speakers. In an alternate embodiment, the electronics, player, and power supply occupy the vacant space behind a panel on the side of the tool chest and outside of the drawer rails.

There has thus been outlined, rather broadly, the more important features of the invention in order that the detailed description thereof that follows may be better understood and that the present contribution to the art may be better appreciated. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved sound system for industrial tool chests.

Another object is to provide such a sound system that installs readily upon existing tool chests with minimal interference with the tools contained therein.

Another object is to provide such a sound system that transmits base and treble sound utilizing the frame of a tool chest.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
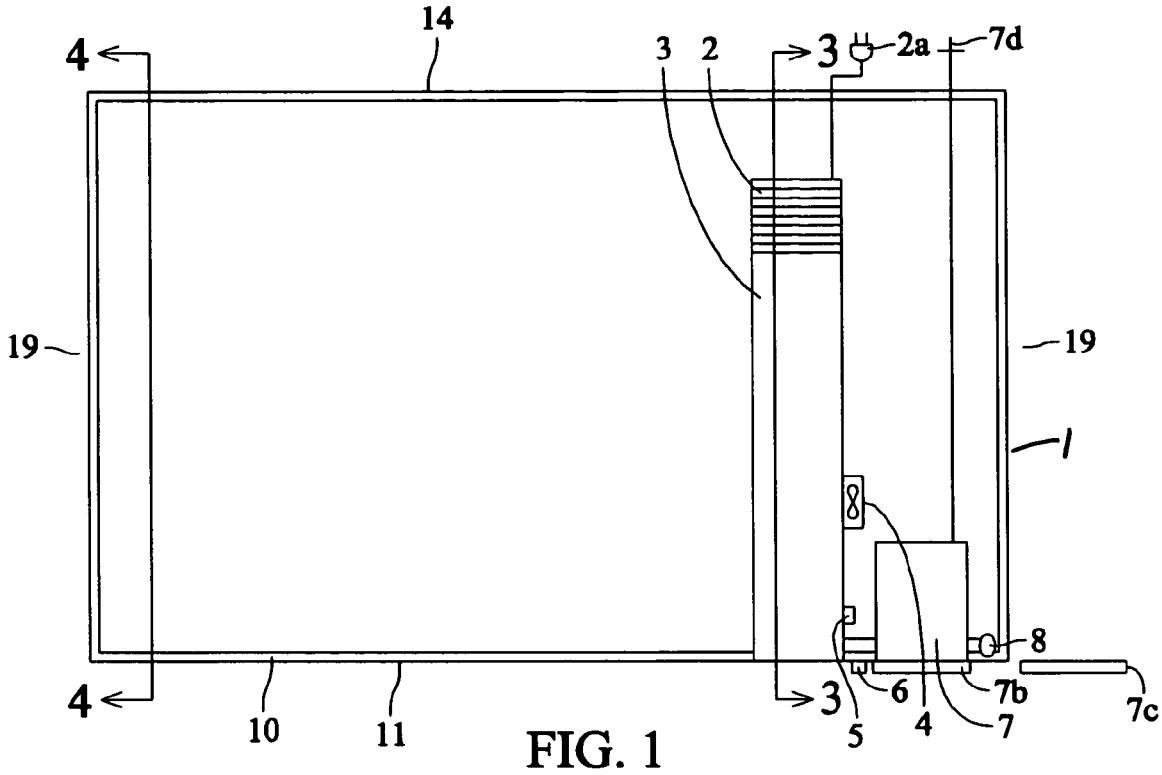
FIG. 1 shows a top view of the preferred embodiment of the sound system for industrial tool chests constructed in accordance with the principles of the present invention.

The present art overcomes the prior art limitations by providing speakers, components, wiring, and dampening upon the frame of a tool chest for use as a sound system. Beginning with FIG. 1, the preferred embodiment of the sound system 1 includes one or more power supplies 2, an air duct 3 with one or more fans 4, a dropping resistor 5 and other electronics, a lighted power switch 6, a combination player 7, a reinforcing tube 8 and an antenna 7*d* all contained in the top 9 of a tool chest 10. A tool chest 10 has a generally rectangular shape when viewed upon the side 19, the front 11, and the top 9. The top 9 of the tool chest 10 comprises the space above the drawers 12 and beneath the top 9 of the tool chest 10. With the tool chest 10 revealed in a top view as in FIG. 1, a portion of the present invention installs in the top 9 of the tool chest 10. A power cord 2*a* enters the top 9 through an opening in the rear 14 of the tool chest 10. The power cord 2*a* continues to a power supply 2. The power supply 2 receives and transforms one hundred ten volt or equivalent electrical service into twelve volt service for electronic components 5. The power supply 2 includes a ground fault circuit interrupt to reduce the risk of a short circuit from water or other shop hazards. As the power supply 2 and components generate heat as a byproduct 3 of their operations, the power supply 2 adjoins and air duct 3. The air duct 3 is generally parallel to the lateral axis of the tool chest 10 and generally located at one third the length of the tool chest 10. The air duct 3 extends from the rear 14 to the front 11 of the tool chest 10 and includes a cooling fan 4. The cooling fan 4 abuts the side of the air duct 3, draws air through the duct 3 and over the power supply 2 and electronic components, and pulls air from the duct 3 towards the rear 14 of the player 7. The cooling fan 4 circulates air within the confines of the tool chest 10 so, the tool chest 10 and its contents take up heat from the air as a heat sink. Additional cooling fans 4 may be installed as necessary to keep the present invention 1 within operating temperatures and the tool chest 10 cool to the touch.

Towards the front 11 and away from the cooling fan 4, the present invention has a dropping resistor 5. The dropping resistor 5 reduces the voltage to the lighted power switch 6, thus the brightness of the lighted power switch 6 and reduces the load upon the power supply 2. The dropping resistor 5 in combination with the lighted power switch 6 indicates that the player 7 is on when the lighted power switch 6 illuminates. Proximate to the dropping resistor 5 and the player 7, an on switch 6 allows the operation of the present invention. Pressing of the on switch 6 delivers power to the player 7 and activates the fan 4.

In the preferred embodiment, the player 7 mounts within the top 9 of the tool chest 10 and faces through the front 11. The player 7 provides singly or in combination, AM, FM, TV, XM, or satellite radio audio play; compact disc, MP3, WMA, DVD, or other recorded media audio play; or, one or more screens, such as LCD or plasma, for TV, cable TV, satellite TV, DVD, or other video play. The player 7 has a DIN style rectangular shaped box 7*a* common on the automotive after market, where DIN is the German Institute for Standardization and the style of box is DIN ISO7736 which provides an opening of approximately 7 inches wide and 2 inches tall. A face plate 7*b* upon the player 7 allows a technician to control the player 7 as to volume, equalizing, and the like. The player 7 includes one or more amplifiers that allow the technician to manipulate sound during use of the present invention 1. The faceplate 7*b* attaches to the player by a manufacturer's method, such as hooks or latches. In the preferred embodiment, the player 7 also has a removable nameplate 7*c* that conceals the player when not in use. The nameplate 7*c* attaches to the tool chest front panel directly over the player 7 by magnetic means such as strips, buttons, and the like. The nameplate 7*c* may indicate a tool chest manufacturer or tool supplier, e.g. Snap-On®, Mac Tools®. Beneath the player 7*a* reinforcing member or tube 8 stiffens the front 11 of the tool chest 10 where material has been removed to mount the player 7 in the front panel of the chest 10. The tube 8 has a diameter to fit beneath the player 7 and welded to the frame of the tool chest 10. In the preferred embodiment, the tube 8 is one of galvanized steel or conduit. Extending from the rear 14, typically, of the player 7, an antenna 7*d* provides reception for broadcast radio signals in the AM, FM, or other bands. An alternate embodiment includes an antenna 7*d* to receive the XM, Sirius, or other bands. The antenna 7*d* spans from the front 11 of the tool chest 10 and exits the rear 14 of the tool chest 10. The antenna 7*d* has a generally flexible tubular shape upon a pivot. The flexible action reduces damage to the antenna from impacts and rough handling.

Figure 2:
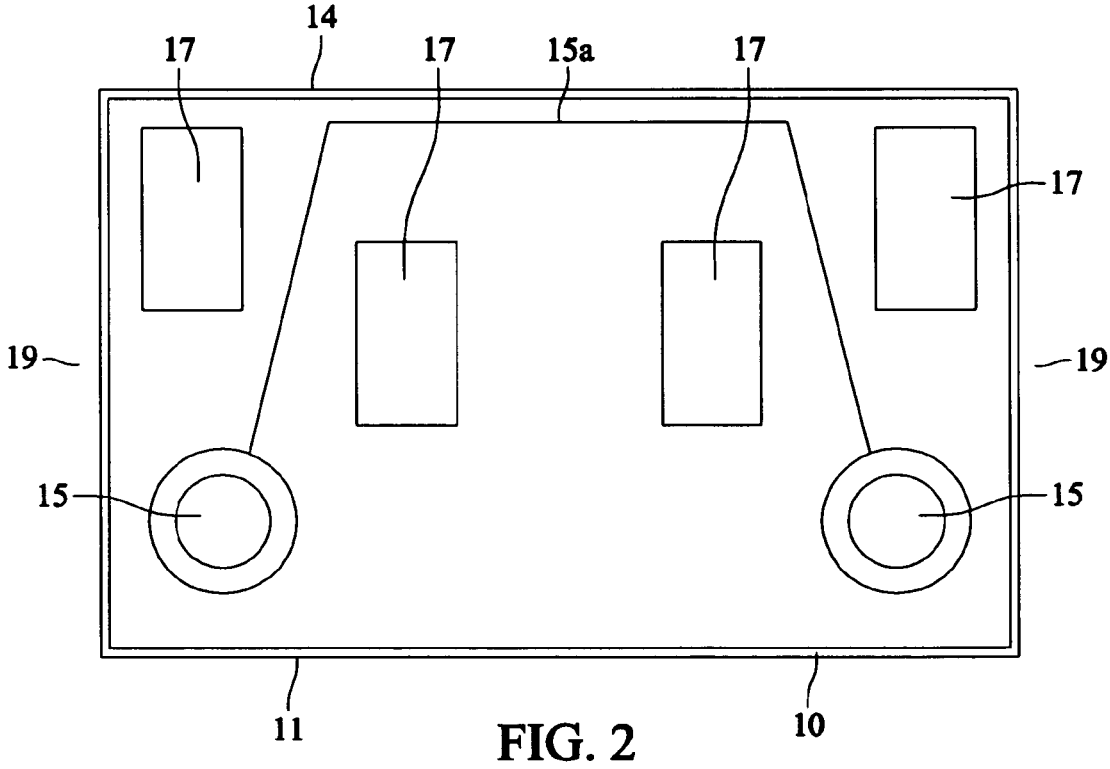
FIG. 2 shows a bottom view of the preferred embodiment of the sound system for industrial tool chests.

Opposite from FIG. 1, FIG. 2 shows the bottom 16 of the tool chest 10 viewed from below. The speakers 15 are installed generally in the outer thirds of the bottom 16. The speakers 15 join to spacers 15*a*, which are mounted surrounding circular holes in the bottom panel 16 and direct their sound below the tool chest 10. The speakers 15 are generally round and are mounted to the bottom panel 16 in the unused space of the tool chest 10 for concealment purposes. Rearward of each speaker 15 and inwards of each speaker 15, a damper pad 17 attaches to the interior side of the bottom panel 16, with two or more damper pads 17 in the invention 1. The damper pads 17 mute vibrations induced into the sheet metal of the bottom 16. The sound system 1 and its components attach to an existing tool chest 10 without altering the operation of the drawers 12 of the tool chest 10.

Figure 3:
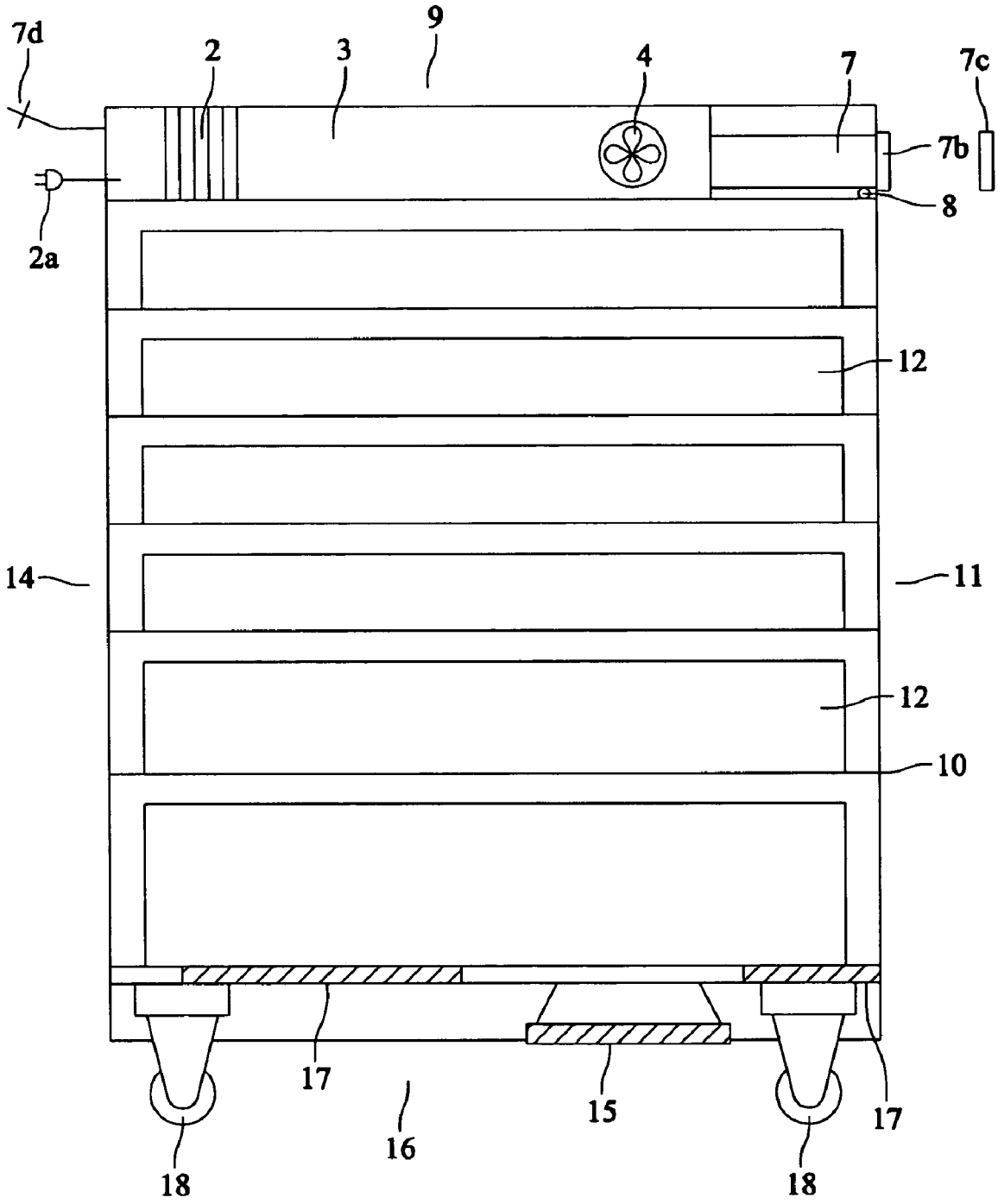
FIG. 3 shows a side view of the preferred embodiment of the sound system for industrial tool chests.

Turning to view the industrial tool chest 10 in a section, FIG. 3 shows the present invention installed in the vacant and unused spaces of a tool chest 10. In the preferred embodiment, a tool chest 10 has an unused layer above the topmost drawer 12 and beneath the top 9 of the tool chest 10. The unused upper layer provides ample room to install the power supply 2, duct 3, and cooling fan 4 in line with each other. Adjacent to the duct 3, a player 7 installs through the front 11 of the tool chest 10. The player 7 rests upon a reinforcing tube 8 that spans from the end of the tool chest 10 to beneath the air duct 3. The reinforcing tube 8 stiffens the front 11 of the tool chest 10 in the absence of panel material removed for the player 7. A removable face plate 7*b* covers the player 7 and abuts the front 11. The face plate 7*b* temporarily attaches to the front 11 by manufacturer's method such as hooks or loops. In the absence of the face plate 7*b*, a nameplate 7*c* conceals the player 7 to thwart thieves.

Opposite the top 9 of the tool chest 10, the bottom 16 has vacant space beneath the lowest drawer 12 and between the wheels 18. In the preferred embodiment, the present invention has two or more speakers 15 attached to the bottom 16 of the tool chest 10 between the wheels 18 and generally towards the front 11. The speakers 15 point beneath the tool chest 10 to transmit sound to the floor for reflection out to the shop. Behind the speaker 15 towards the interior of the tool chest 10, the present invention has one or more damper pads 17. The damper pads 17 attach to the bottom panel 16 and span nearly the depth of the tool chest 10. The damper pads 17 absorb sound vibrations in the sheet metal panel caused by the speaker thus reducing the interference of the rear sound wave of the speakers 15 with the front sound wave of the speakers. Typically, a speaker 15 generates sound with front waves however, a portion of the front waves attempt to reach the rear of the speaker in the absence of a baffle. Here, the bottom panel 16 serves as a baffle that allows both front and rear sound waves to propagate from the speaker 15. Alternatively, if a technician seeks more sound, the present invention 1 has one or more additional speakers 15 wired to the present invention 1 and located in the topmost vacant layer beneath the top 9 of the tool chest.

Figure 4:
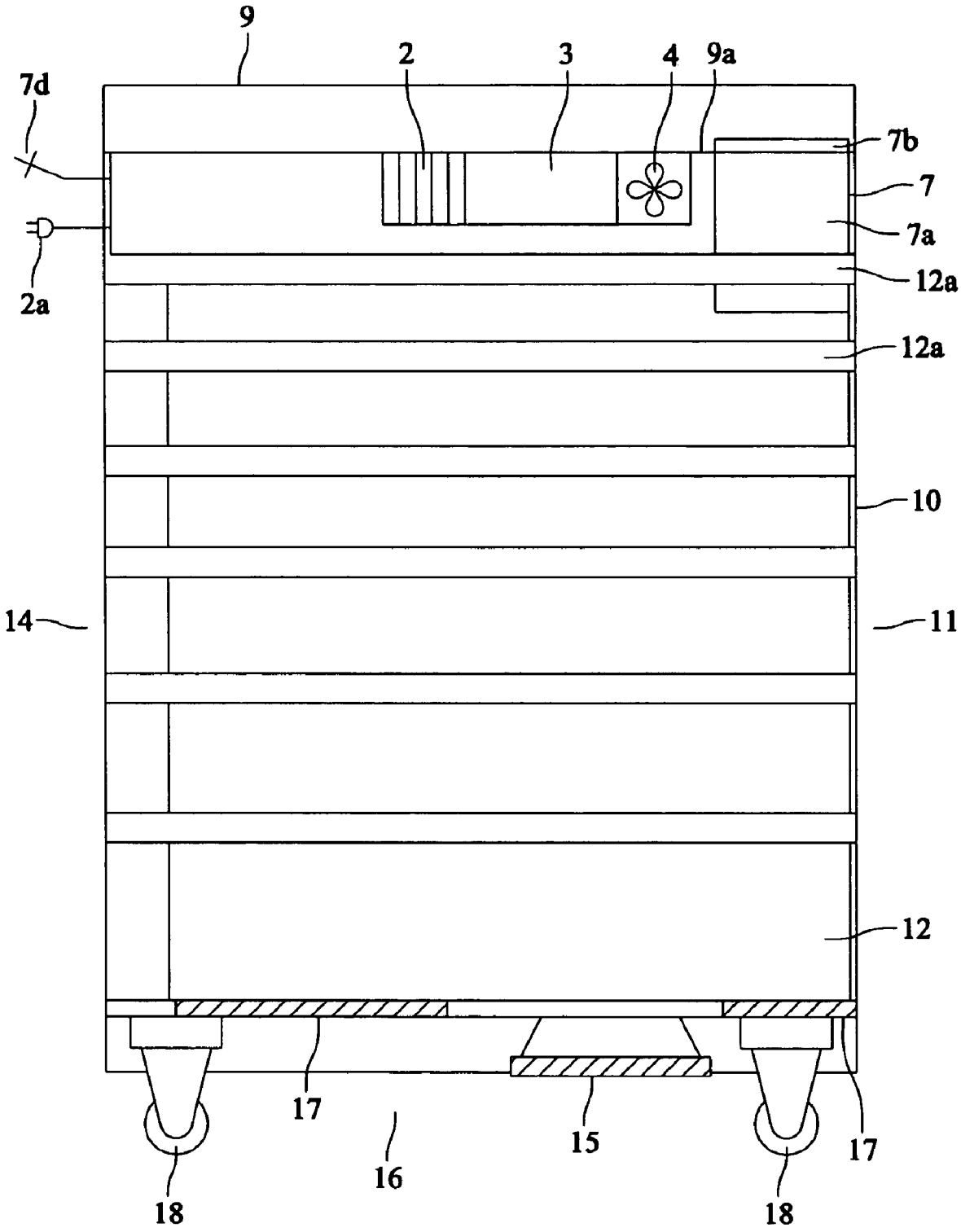
FIG. 4 shows a side view of an alternate embodiment of the present invention; and, FIG. 5 describes a side view of a further alternate embodiment where the present invention is installed in the upper story of a two story tool chest.

Viewing another section, FIG. 4 shows the present invention installed in the vacant and unused spaces of a tool chest 10 as an alternate embodiment. Here, a tool chest 10 has vacant space between the drawer rails 12*a* and a side 19 panel. The vacant space provides ample room to install the power supply 2, duct 3, and cooling fan 4 in line with each other and between the rails and the panel. Adjacent to the front 11, the player 7 installs through the flat panel 9*a* above the topmost drawer 12. The player 7 extends downward between the drawer rails 12*a* and the side 19 panel. Inward of the player 7, the cooling fan 4 attaches to the air duct 3 that proceeds rearward ending in the power supply 2. The power supply 2, air duct 3, cooling fan 4, electronic parts, wiring and antenna 7*d*, fit within the drawer rails 12*a*, the side 19 panel and the flat panel above the top drawer. A removable faceplate 7*b* covers the player 7 and abuts the panel above the topmost drawer 12. Alternatively, one or more additional speakers 15, not shown, and appurtenant wiring are installed upon panel 9*a* to provide more sound as desired by the technician.

As in the preferred embodiment, the present invention has two or more speakers 15 attached to the bottom 16 of the tool chest 10 between the wheels 18 and generally towards the front 11. The speakers 15 point towards the bottom 16 of the tool chest 10 to transmit sound to the floor for reflection out to the shop. Behind the speaker 15 towards the interior of the tool chest 10, the present invention has one or more damper pads 17. The dampers 17 attach to the bottom panel 16 and span nearly the depth of the tool chest 10. The damper pads 17 absorb sound vibrations in the sheet metal panel caused by the speaker thus reducing the interference of the rear sound wave of the speakers 15 with front sound wave of the speakers. Typically, a speaker 15 generates sound with front waves however, a portion of the front waves attempt to reach the rear of the speaker in the absences of a baffle. Here, the bottom panel 16 serves as a baffle that allows both front and rear sound waves to propagate from the speaker 15.

Figure 5:
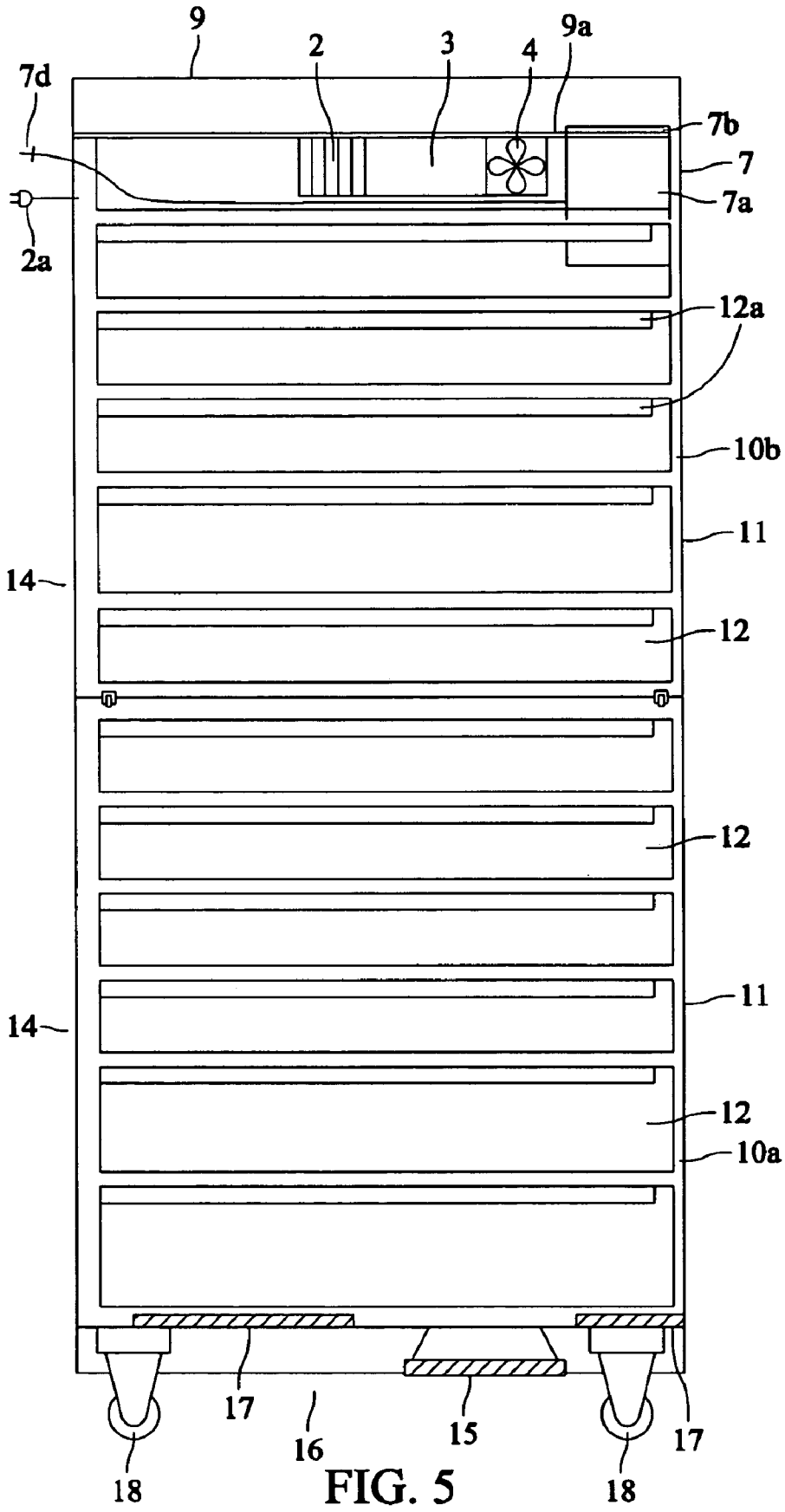

Tool chests often have multiple stories as shown in FIG. 5. An upper chest 10*b* stacks upon and bolts to a lower chest 10*a* to provide more drawers for technicians and to assist manufacturers in shipping of the tool chests 10. The present invention 1 fits within the stories 10*a*, 10*b* of a tool chest 10. The speakers 15 and damper pads 17 attach to the bottom 16 of the lowest story 10*a* while the player 7, power supply 2, duct 3, fan 4 and appurtenant wiring and electronics 5, 6 fit within the highest story 10*b* similar to FIG. 4. Wiring connects the player 7 with the speakers 15 and in this form, the present invention 1 provides a longer power cord 2. Technicians operate the present invention 1 from within the topmost vacant space near panel 9*a*. Alternatively, additional speakers 15, not shown, are located upon the top panel 9*a* to provide more sound to the taste of the technician.

From the aforementioned description, a sound system for industrial tool chests has been described. The sound system is uniquely capable of modifying an existing tool chest with electronics and speakers to transmit sounds in a shop or other trade environment. The sound system and its various components may be manufactured from many materials including but not limited to plastics, polymers, high density polyethylene HDPE, polypropylene PP, polyvinyl chloride PVC, nylon, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A tool chest has a front, an opposite rear, a top, perpendicular to the front, a bottom opposite said top, and two sides perpendicular to the front and the rear, generally in a rectangular shape; lateral and longitudinal rectangular frames and lateral drawers, the lateral frames having rails to support multiple stacked drawers; metal paneling to sheath the rear, top, bottom, and sides of the tool chest; and wheels attached to the bottom of the tool chest; and, vacant spaces between the frames and the metal paneling, wherein the improvement comprises:

one or more power supplies with a power cord;

an air duct extending from said power supply, said air duct locating within the interior of the tool chest and being a separate component from the tool chest;

one or more fans mounting upon said air duct generally opposite said power supply, said one or more fans drawing air through said duct to said one or more power supplies; said one or more fans and said air duct adapting to fit within the vacant space between the frames and the metal paneling of a tool chest without interfering with a drawer;

a dropping resistor connected to a lighted power switch, reducing the voltage to said lighted power switch and thus the brightness of said lighted power switch;

a player adapting to fit within the vacant space between the frames and the metal paneling of a tool chest, said player locating away from a drawer, connected to said lighted power switch and said power supply by wiring whereby, when said power switch is illuminated said player and said fan operate simultaneously;

an antenna connecting to said player and extending out of the rear of the tool chest, said antenna adapting to pivotally connect to the tool chest;

a means to reinforce the front of the tool chest near said player;

one or more speakers in electrical communication with said player, said speakers adapted to mount to the bottom of the tool chest, and said speakers projecting sound downwardly beneath the tool chest; and, one or more damper pads adapted to mount to the bottom of the tool chest, adjacent to said speakers;

whereby said power supplies, said air duct, said fans, said dropping resistor, said illuminated power switch, said player, said antenna, and said reinforcing means are collocated;

whereby said speakers and said damper pads are mounted generally in the existing vacant spaces of the tool chest without interfering in the layout and operations of the lateral drawers, thus said speakers provide sound from said player to the environment around the tool chest.

2. The tool chest of claim 1 wherein said player is capable of playing television signals.

3. The tool chest of claim 2 further comprising:

said player having a DIN style case.

4. The tool chest of claim 3 further comprising:

said power supply, said air duct, said fan, said dropping resistor, said lighted power switch, said player, said antenna, and said reinforcing means installing beneath the top of the tool chest and above the topmost drawer of said tool chest;

said reinforcing means having a tube, generally round, located beneath the player to reinforce the front panel; and, said speakers and said damper pads mounting to the bottom of the tool chest generally between the wheels to provide sound underneath the tool chest and then to the environment around the tool chest.

5. The tool chest of claim 4 further comprising:

four of said speakers and four of said damper pads.

6. The tool chest of claim 3 further comprising:

said power supply, said air duct, said fan, said dropping resistor, said lighted power switch said player, said antenna, and said reinforcing means installing between a side panel and the rails of the drawers proximate to the topmost drawer;

said reinforcing means having a plate generally rectangular and with a rectangular opening, said plate contiguous with face of said player; and, said speakers and said damper pads mounting to the bottom of the tool chest generally between the wheels to provide sound underneath the tool chest and then to the environment around the tool chest.

7. The tool chest of claim 6 further comprising:

four of said speakers and four of said damper pads.

8. The tool chest of claim 6 wherein the tool chest has two or more stories of drawers stacked vertically; wherein said speakers and said damper pads are mounted below the bottom of the lowest story.

* * * * *